US010286286B1

(12) United States Patent
Ryan

(10) Patent No.: US 10,286,286 B1
(45) Date of Patent: May 14, 2019

(54) TREADMILL SAFETY DEVICE

(71) Applicant: Gerald P. Ryan, Geneva, IL (US)

(72) Inventor: Gerald P. Ryan, Geneva, IL (US)

( * ) Notice: Subject to any disclaimer, the term of this patent is extended or adjusted under 35 U.S.C. 154(b) by 0 days.

(21) Appl. No.: 15/643,797

(22) Filed: Jul. 7, 2017

Related U.S. Application Data

(60) Provisional application No. 62/360,137, filed on Jul. 8, 2016.

(51) Int. Cl.

| | |
|---|---|
| ***A63B 71/00*** | (2006.01) |
| ***A63B 24/00*** | (2006.01) |
| *A63B 22/02* | (2006.01) |

(52) U.S. Cl.
CPC ..... *A63B 71/0054* (2013.01); *A63B 24/0087* (2013.01); *A63B 22/0235* (2013.01); *A63B 2071/0081* (2013.01); *A63B 2225/52* (2013.01)

(58) Field of Classification Search
None
See application file for complete search history.

(56) References Cited

U.S. PATENT DOCUMENTS

| | | | | |
|---|---|---|---|---|
| 5,368,532 | A * | 11/1994 | Farnet | A63B 22/02 482/5 |
| 5,690,587 | A * | 11/1997 | Gruenangerl | A63B 22/02 482/54 |
| 6,733,423 | B1 * | 5/2004 | Chang | A63B 22/02 482/51 |
| 7,713,172 | B2 | 5/2010 | Watterson et al. | |
| 7,862,475 | B2 | 1/2011 | Watterson et al. | |
| 8,394,002 | B2 * | 3/2013 | Park | A63B 21/0053 482/51 |
| 8,480,541 | B1 * | 7/2013 | Brunts | A63B 22/0242 482/1 |
| 9,149,683 | B2 | 10/2015 | Watterson et al. | |
| 9,943,722 | B2 * | 4/2018 | Dalebout | A63B 24/0062 |
| 2006/0189440 | A1 | 8/2006 | Gravagne | |
| 2009/0176629 | A1 * | 7/2009 | Yi | A63B 22/0242 482/54 |
| 2010/0160115 | A1 * | 6/2010 | Morris | A63B 22/0235 482/4 |
| 2012/0319846 | A1 | 12/2012 | Rogers | |

* cited by examiner

*Primary Examiner* — Stephen R Crow
(74) *Attorney, Agent, or Firm* — Clifford H. Kraft

(57) ABSTRACT

A treadmill safety system that detects the runner or treadmill user without the need for attaching a string to the runner. It includes two basic components: 1) a distance or proximity sensor, laser, ultrasonic, IR, or other and 2) a method to kill treadmill power in the case the runner is not detected in position by the sensor. This can be by deactivation by electromagnet as in present treadmills, interruption of main power, or by any other method.

19 Claims, 3 Drawing Sheets

TREADMILL SAFETY DEVICE

This application claims priority from U.S. Provisional patent application No. 62/360,137 filed Jul. 8, 2016. Application 62/360,137 is hereby incorporated by reference in its entirety.

BACKGROUND

Field of the Invention

The present invention relates generally to sports safety devices and more particularly to a sensor that senses when a runner is on a treadmill exercise device.

Description of the Problem Solved

The vast majority of exercise treadmills use a magnet attachment point on the treadmill as a safety device. The user attaches the safety magnet to the attachment point. The magnet itself, is attached to a string with a safely clip on the other end. The safety clip, in turn, should be attached to the runner. If the runner falls from the treadmill, he/she pulls the magnet from the attachment point, at which time, the treadmill shuts down. It's a simple method, and it works well. The problem is that many runners don't attach the safety clip to themselves. This is because a run is often halted because the runner knocks the retaining string with his/her hand such that the magnet is pulled from the attachment point. The run totals are cleared at this point, and the runner has to restart the treadmill. It would be very advantageous to have a safety device that would work with existing treadmill magnet attach points, but not have a safety string.

SUMMARY OF THE INVENTION

The improved treadmill safety key of the present invention is a device that detects the runner without the need for attaching a string to the runner. It includes two basic components: 1) a distance or proximity sensor, laser, ultrasonic, IR, or other and 2) a method to kill treadmill power in the case the runner is not detected in position by the sensor. This can be by deactivation by electromagnet as in present treadmills, interruption of main power, or by any other method.

DESCRIPTION OF THE FIGURES

Attention is now directed to several figures that illustrate features of the present invention.

Several drawings and illustrations have been presented to aid in understanding the present invention. The scope of the present invention is not limited to what is shown in the figures.

DESCRIPTION OF THE PREFERRED EMBODIMENTS

The present invention relates to an improved safety device for a treadmill or other exercise equipment. The improved safety device senses the distance of the runner with a proximity sensor. The runner attaches the safety device to the treadmill, aims it at his/her midsection, and turns it on.

The proximity sensor measures the runner's distance, and calculates a safety trigger threshold. If the runner's distance from the sensor exceeds the safety limit, the safety key disables the treadmill.

For a majority of the treadmills, the disabling mechanism can be in the form of an electromagnet. The electromagnet of the invention takes the place of the commonly used permanent magnet and will stay engaged to the securing point as long as the runner is at the proper distance from the detector. But, if an unsafe distance is detected, the electromagnet shuts off, killing the treadmill. This method is backward compatible with the majority of the treadmills in existence.

Another disabling mechanism can be an AC power kill switch connected to the distance sensor via a wireless link such as a Bluetooth™ (or other) link. The user can plug the treadmill into the AC power kill switch, and then plug the power kill switch into the wall. The kill switch only turns on at the command of the distance sensing safety switch. For this type of safety switch, the user connects the safety switch to the treadmill, and turns it on. The unit will, as described above, detect the runner and calculate a safe distance threshold. Power will then be available to the treadmill, and the user can start his/her run. If the sensor detects an unsafe distance condition, it sends a signal commanding the AC power switch to disengage the AC power feed to the treadmill, thus disabling the treadmill.

Figure 1:
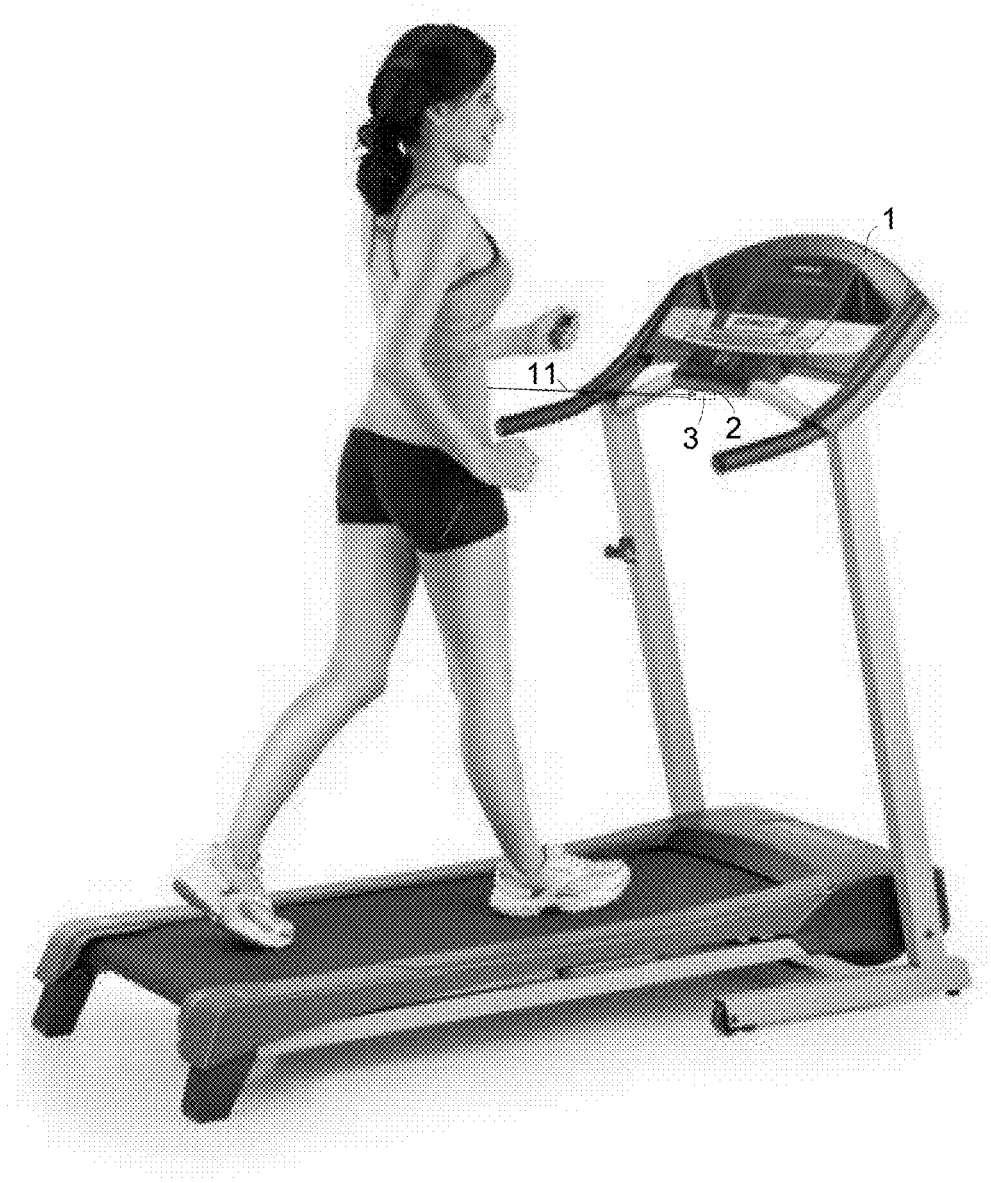
FIG. 1 shows an embodiment of the present invention in use with a treadmill.

FIG. 1 shows a treadmill 1 with a magnet attach point 2 that is supplied typically as standard equipment. The present invention includes a small sensor housing 3 that contains an electromagnet. When switched on, the electromagnet energizes the treadmill 1 if the sensor senses proximity of a user within a predetermined safe distance. Typically, an invisible beam of light 11 or sound reflects from the user and is used by an internal processor to measure distance. In FIG. 1, the magnet attachment point is the red item in the lower middle of the treadmill console just above the housing 3.

Figure 2:
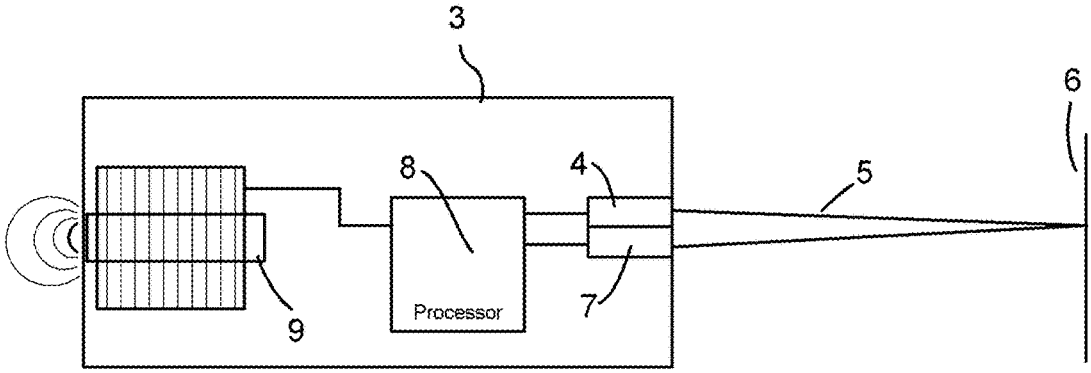
FIG. 2 shows a opened drawing of the components inside the sensor housing.

FIG. 2 shows the inside view of an embodiment of the device. A housing 3 holds a sensor 4 which can be any type of distance measuring sensor or proximity sensor. The preferred is an infrared (IR) sensor or an ultra-sonic sensor. The sensor 4 (in the case of an IR sensor) sends a beam of light 5 that reflects from the user 6 and returns to an optical detector 7. The optical detector 7 feeds a signal to a processor 8 that computes the distance. If the distance is within prescribed limits, it enables an electromagnet 9 which interfaces with the existing port on the treadmill to enable the treadmill. As previously stated, if the sensed distance exceeds a predetermined range, or there is no return detected, the processor 8 shuts off the electromagnet 9 causing the treadmill to stop. Any type of distance measuring or proximity sensor is within the scope of the present invention. The unit can be battery powered (battery not shown).

Figure 3:
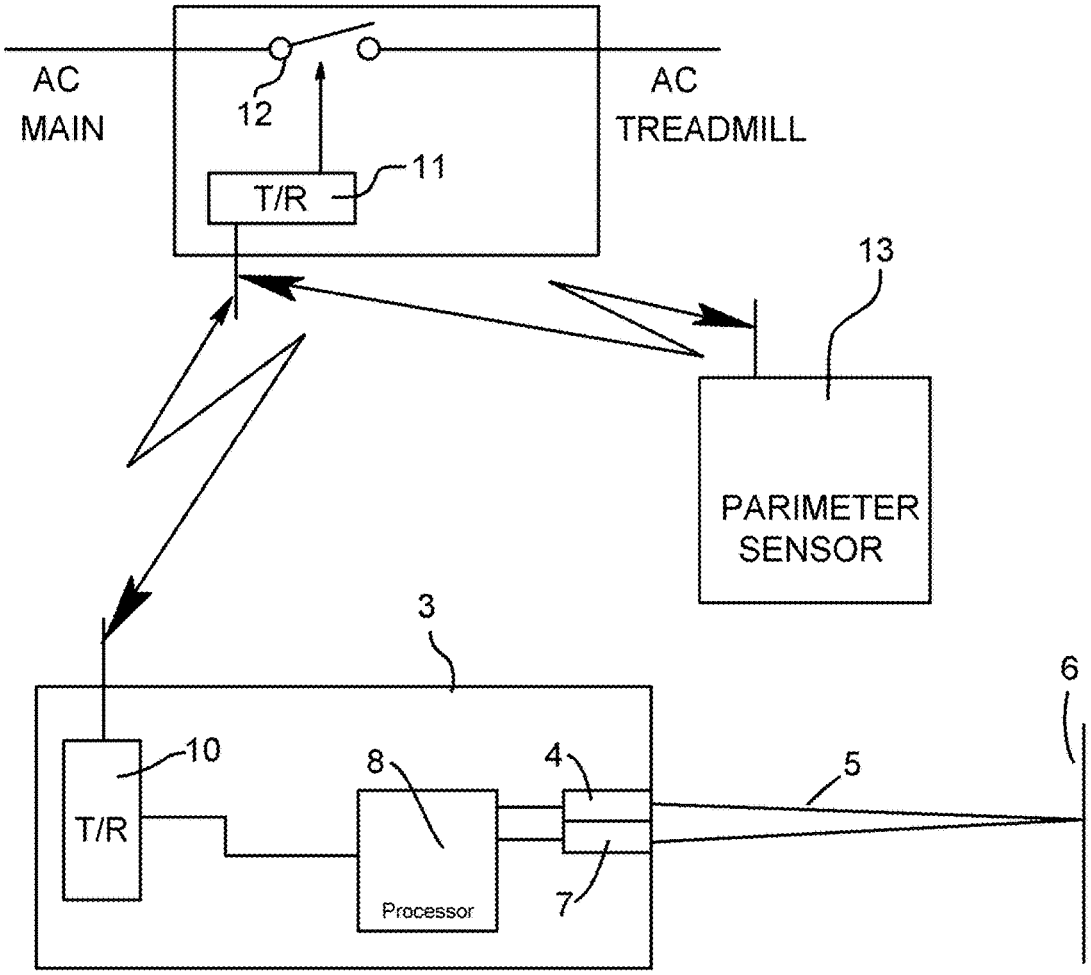
FIG. 3 shows a opened drawing of an embodiment of the present invention using a wireless link.

FIG. 3 shows a wireless version of the invention. Here, the sensor is as before, but the processor 8 interfaces with a wireless transmitter 10. The wireless transmitter (or transmitter/receiver) 10 sends a radio signal to a receiver 11 that controls a AC power to the treadmill through a switch 12. If the sensor signal shows the user is out of range or there is no return, the processor 8 sends a message to the receiver 11 via the wireless transmitter 10. The receiver 11, either alone, or with a second processor, shuts of AC power deactivating the treadmill.

In particular embodiments, the present invention can also be connected to sensors 13 that detect the proximity of other individuals or pets that are too close to the surface of the treadmill. Optic beam sensors, or other sensors, can be added to the system such that if the beam is broken, an RF signal is sent to the kill mechanism (either the electromagnet or the A/C interrupt switch). In this way, a safety wall can be built around the tread surfaces that can prevent a child or pet from getting inadvertently stuck in the tread surface. The electromagnet or controller for these embodiments requires a receiver (BLUETOOTH™ or other) to connect to the perimeter sensor as shown in FIG. 3.

In some embodiments, the sensor that detects the actual runner and the electromagnet may be in two different housings, so that one housing can hold a sizable rechargeable battery while keeping the electromagnet as light as possible (thus not adding to the required current drive on the magnet). These housings can then be wired together with enough wire to handle the drive current on the electromagnet. Any number of housings is within the scope of the present invention.

While the above description has focused on treadmills, the safety device of the present invention may be used with any mechanical exercise equipment that needs to be deactivated if a user slips or falls off the equipment.

Several descriptions and illustrations have been presented to aid in understanding the present invention. One with skill in the art will realize that numerous changes and variations may be made without departing from the spirit of the invention. Each of these changes and variations is within the scope of the present invention.

I claim:

1. A safety device for an exercise treadmill comprising:
a distance measuring sensor mountable on the treadmill adapted to measure distance between a user on the treadmill and a point on the treadmill, the distance measuring sensor in communication with a controller adapted to stop the treadmill if the distance between the user and the point on the treadmill exceeds a predetermined limit;
wherein said communication with the controller includes a wireless receiver, and the controller controls AC power to the treadmill.

2. The safety device of claim 1 wherein the sensor is coupled to an electromagnet attached to the treadmill; the electromagnet configured to disable the treadmill.

3. The safety device of claim 1 wherein the sensor is an infrared sensor.

4. The safety device of claim 3 wherein the infrared sensor includes an infrared transmitter and an infrared receiver.

5. The safety device of claim 4 wherein the infrared sensor is constructed to reflect infrared light from the infrared transmitter off of the user to the infrared receiver.

6. The safety device of claim 1 further comprising a signal processor constructed to compute distance between the user and the point on the treadmill.

7. The safety device of claim 1 wherein the sensor is coupled to an electromagnet placed in proximity to an existing magnet sensor on the treadmill.

8. The safety device of claim 7 wherein the sensor enables the electromagnet when the distance between the user and the point on the treadmill is within safe operating limits and disables the electromagnet when said distance is not within safe operating limits.

9. The safety device of claim 1 wherein the point on the treadmill is located on a treadmill control panel attached to the treadmill.

10. A safety device for an exercise treadmill comprising:
an electromagnet;
a distance sensor:
wherein:
the distance sensor is coupled to the electromagnet through a controller such that the controller can energize or de-energize the electromagnet;
the distance sensor is attached to the treadmill in a manner wherein it can measure a parameter related to distance between itself and a user on the treadmill;
wherein the controller computes a distance between the distance sensor and the user using said parameter and energizes the electromagnet if said distance is within a predetermined value or de-energizes the electromagnet if it is not.

11. The safety device of claim 10 wherein the distance sensor is an infrared sensor.

12. The safety device of claim 11 wherein the infrared sensor reflects light from said user.

13. The safety device of claim 10 wherein the electromagnet is attached to the treadmill in proximity to an existing magnetic sensor on the treadmill.

14. The safety device of claim 10 further comprising a wireless communications link between the sensor and the controller.

15. A safety device for an exercise treadmill comprising:
an electromagnet;
an distance sensor:
a wireless communications system;
wherein:
the distance sensor is wirelessly coupled to a controller which is coupled to the electromagnet such that the controller can energize or de-energize the electromagnet;
the distance sensor is attached to the treadmill in a manner wherein it can measure a parameter related to distance between itself and a user on the treadmill;
wherein the controller computes a distance between the distance sensor and the user using said parameter and energizes the electromagnet if said distance is within a predetermined value or de-energizes the electromagnet if it is not.

16. The safety device of claim 15 wherein the sensor is an infrared sensor.

17. The safety device of claim 16 wherein the infrared sensor reflects light from said user.

18. The safety device of claim 15 wherein the wireless communication system is a radio system.

19. The safety device of claim 15 wherein the sensor is ultrasonic.

* * * * *